US006793591B2

(12) United States Patent
Takeda

(10) Patent No.: US 6,793,591 B2
(45) Date of Patent: Sep. 21, 2004

(54) GOLF CLUB AND METHOD OF PRODUCING THE SAME

(75) Inventor: Hitoshi Takeda, Tsubame (JP)

(73) Assignee: K. K. Endo Seisakusho, Tsubame (JP)

( * ) Notice: Subject to any disclaimer, the term of this patent is extended or adjusted under 35 U.S.C. 154(b) by 0 days.

(21) Appl. No.: 10/454,613

(22) Filed: Jun. 5, 2003

(65) Prior Publication Data

US 2004/0082401 A1 Apr. 29, 2004

(30) Foreign Application Priority Data

Oct. 25, 2002 (JP) ..... 2002-310619

(51) Int. Cl.[7] ..... A63B 53/04
(52) U.S. Cl. ..... 473/342; 473/345
(58) Field of Search ..... 473/345–346, 473/342, 324

(56) References Cited

U.S. PATENT DOCUMENTS 5,094,383 A * 3/1992 Anderson et al. ..... 228/176
5,378,295 A * 1/1995 Yamashita et al. ..... 148/654
5,421,577 A * 6/1995 Kobayashi ..... 473/335
5,697,854 A * 12/1997 Aizawa et al. ..... 473/344

FOREIGN PATENT DOCUMENTS

| | | |
|---|---|---|
| JP | 39-21879 | 10/1939 |
| JP | 59-22164 | 2/1984 |
| JP | 61-33971 | 10/1986 |

* cited by examiner

*Primary Examiner*—Stephen Blau
(74) *Attorney, Agent, or Firm*—Westerman, Hattori, Daniels & Adrian, LLP

(57) ABSTRACT

A hollow iron clubhead having a low center of gravity and enabling free selection of a material for the clubface can be readily produced by press working. The hollow iron clubhead mainly comprises a clubface member, a front body member and a rear body member. A blank for forming the clubface member, a blank for forming the front body member and a blank for forming the rear body member are prepared by blanking. The clubface blank and the front body blank are integrally welded together and shaped by hot drawing to form the front body member. The rear body blank is shaped by hot drawing to form the rear body member. The front body member and the rear body member are integrally joined together by welding.

4 Claims, 6 Drawing Sheets

FIG.10

Performance Test

MODEL : Example (#6)
Comparative Example (#6)
No. of iron : #6
Pin point : Center of gravity Material : S20C
Shaft : BK-R (carbon shaft Flex R)
Loft : 27.2

| | Speed | | Longitudinal direction | | | Lateral direction | | |
|---|---|---|---|---|---|---|---|---|
| | Club-head speed (m/s) | Ball speed (m/s) | Upward launch angle (degree) | Back spin (rpm) | Carry (yard) | Rightward launch angle (degree) | Side spin (rpm) | Lateral deflection (yard) |
| Example | 39.3 | 50.5 | 25.7 | 3950 | 177.3 | −0.7 | 243 | 3.0 |
| Comp. Example | 39.1 | 50.4 | 25.4 | 4415 | 172.5 | −1.3 | 258 | 0.5 |

Each value is a weighted mean value calculated from values obtained from three trial shots for each item, excluding MAX and MIN values.

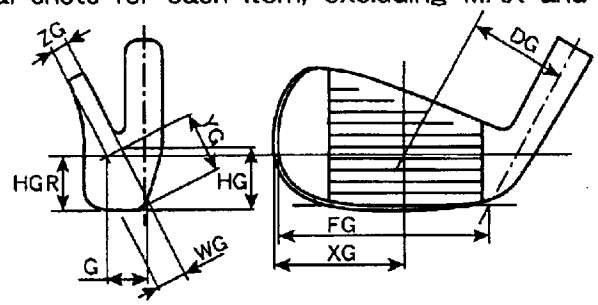

| Model | Loft | Lie | Goose | FG | HG | XG | DG | YG | WG | ZG | HGR | G |
|---|---|---|---|---|---|---|---|---|---|---|---|---|
| Example #6(B) | 27.2 | 61.7 | 4.0 | 83.4 | 23.3 | 49.3 | 40.2 | 21.0 | 16.2 | 6.8 | 20.2 | 15.6 |
| Comp. Example 01#6(B) | 27.2 | 62.2 | 4.2 | 84.1 | 24.6 | 51.0 | 39.4 | 22.0 | 15.6 | 5.7 | 22.0 | 15.2 |

GOLF CLUB AND METHOD OF PRODUCING THE SAME

BACKGROUND OF THE INVENTION

1. Field of the Invention

The present invention relates to a golf club and a method of producing the same. More particularly, the present invention relates to a golf club having a hollow iron clubhead with a hollow therein that is produced mainly by forging and welding. The present invention also relates to a method of producing the golf club.

2. Discussion of Related Art

There is publicly known a method of producing a hollow iron clubhead as follows. A front part including a face and a rear part including a sole are produced as two split parts by forging using a press or the like, and the two parts are welded together to form a hollow iron clubhead, followed by pouring a molten metal into the hollow inside of the clubhead to fill the hollow (for example, see Japanese Patent Application Post-Examination Publication No. Sho 39-21879). There has also been proposed a method of producing a wood golf club, wherein a wood clubhead comprises two parts, i.e. a front part including a face, and a rear part including a sole, and the two parts are integrally welded together with a pipe for mounting a clubshaft (for example, see Japanese Utility Model Application Post-Examination Publication No. Sho 61-33971).

However, the face and the sole require different constituent materials because they are required to perform different functions. For example, the face is a surface for striking a golf ball and hence requires a metallic material capable of exhibiting excellent impact resistance and generating high restitution. If the face part is made of the same kind of metallic material as that used to constitute the sole part, it is necessary to partially increase the wall thickness. Under certain circumstances, a different kind of metal, e.g. pure titanium, is clad to the clubface surface to increase the coefficient of restitution, and the metal-clad face part and the sole part are joined together to form a clubhead. In these cases, the wall thickness of the face part is different from that of the main body part.

Meanwhile, iron clubheads are demanded to have as low a center of gravity as possible from the viewpoint of stability in striking performance. In this regard, if the above-described clubhead producing method using two split parts formed by forging is employed to produce a hollow iron clubhead having the above-described face, the center of gravity cannot be lowered as desired. That is, because the face has an increased wall thickness, if a front part including the face is produced, the overall weight increases, resulting in an undesirably high center of gravity.

Accordingly, the conventional method of producing a clubhead from two split parts is not suitable for producing a hollow iron clubhead having as low a center of gravity as possible. Further, the lower portion of a hosel, which is a part for securing one end of the shaft of an iron golf club is generally a solid structure. Therefore, even if attempts are made to design the iron clubhead so that the center of gravity is lowered, there is a limit to the creation of a lower center of gravity.

SUMMARY OF THE INVENTION

The present invention was made in view of the above-described technical background. Accordingly, the present invention attains the following objects.

An object of the present invention is to provide a golf club designed to create a low center of gravity and to allow the center of gravity to be set at any desired position in the longitudinal direction of the clubhead, and also provide a method of producing the golf club.

Another object of the present invention is to provide a golf club enabling free selection of a material for the clubface to rebound a golf ball, and also provide a method of producing the golf club.

Still another object of the present invention is to provide a golf club that is easy to manufacture and a method of producing the golf club.

To attain the above-described objects, the present invention provides a golf club having a hollow iron clubhead with a hollow therein. The golf club includes a clubface member having a striking face for striking a golf ball. A front body member is integrally welded to the clubface member to constitute a front body portion of the hollow iron clubhead. The front body member has a first hosel portion for forming a tubular hosel communicating with the hollow. A rear body member is integrally welded to the front body member to constitute a rear body portion of the hollow iron clubhead. The rear body member has a second hosel portion for forming the tubular hosel in combination with the first hosel portion.

Preferably, the first hosel portion and the second hosel portion are half hosel portions, respectively. Each half hosel portion has a shape formed by cutting a cylinder along a plane containing a center axis thereof. The half hosel portions are welded together to form the hosel for securing one end of a golf clubshaft.

Further, the clubface member is preferably positioned in a through-hole formed in the front body member and welded to the front body member. Preferably, a weight member is secured to the bottom of the rear body member by welding. Preferably, the clubface member is different in constituent material from the front body member. Preferably, a cylindrical member for securing one end of a golf clubshaft is joined to the hosel by welding.

In addition, the present invention provides a method of producing a golf club having a hollow iron clubhead with a hollow therein. According to the golf club producing method, a sheet material is cut to form a clubface member having a striking face for striking a golf ball. A sheet material is subjected to press working to form a front body member that is to be integrally welded to the clubface member to constitute a front body portion of the hollow iron clubhead. The clubface member and the front body member are integrally welded together. A sheet material is subjected to press working to form a rear body member that is to be integrally welded to the front body member to constitute a rear body portion of the hollow iron clubhead. The front body member, which has been integrally welded with the clubface member, and the rear body member are integrally welded together to form the hollow iron clubhead.

Preferably, the golf club producing method according to the present invention is carried out as follows. A clubface blank for forming the clubface member is prepared by blanking. A front body blank for forming the front body member is prepared by blanking. The clubface blank and the front body blank are integrally joined together by welding. The integral assembly of the front body blank and the clubface blank is drawn to form the front body member. A rear body blank for forming the rear body member is prepared by blanking. The rear body blank is drawn to form the rear body member. The front body member and the rear body member are integrally joined together by welding.

Preferably, a through-hole is formed in the front body blank by punching, and the clubface member is positioned in the through-hole and welded to the front body member.

Preferably, the drawing performed on the clubface blank, the front body blank and the rear body blank is hot working in which a material is drawn under heating to not less than the recrystallization temperature of the material.

Preferably, the front body blank and the rear body blank have respective half hosel portions for forming in combination a hosel for securing one end of a golf clubshaft. Each half hosel portion has a shape formed by cutting a cylinder along a plane containing a center axis thereof.

Preferably, a cylindrical member for securing one end of a golf clubshaft is joined to the hosel by welding.

BRIEF DESCRIPTION OF THE DRAWINGS

The above and other objects, features and advantages of the present invention will become more apparent from the following description of the preferred embodiments thereof, taken in conjunction with the accompanying drawings.

FIG. 10 is a diagram showing comparatively data concerning shots played with an iron golf club according to an example of the present invention and an iron golf club according to a comparative example and data concerning the gravity center positions thereof.

DESCRIPTION OF THE PREFERRED EMBODIMENT

Figure 1:
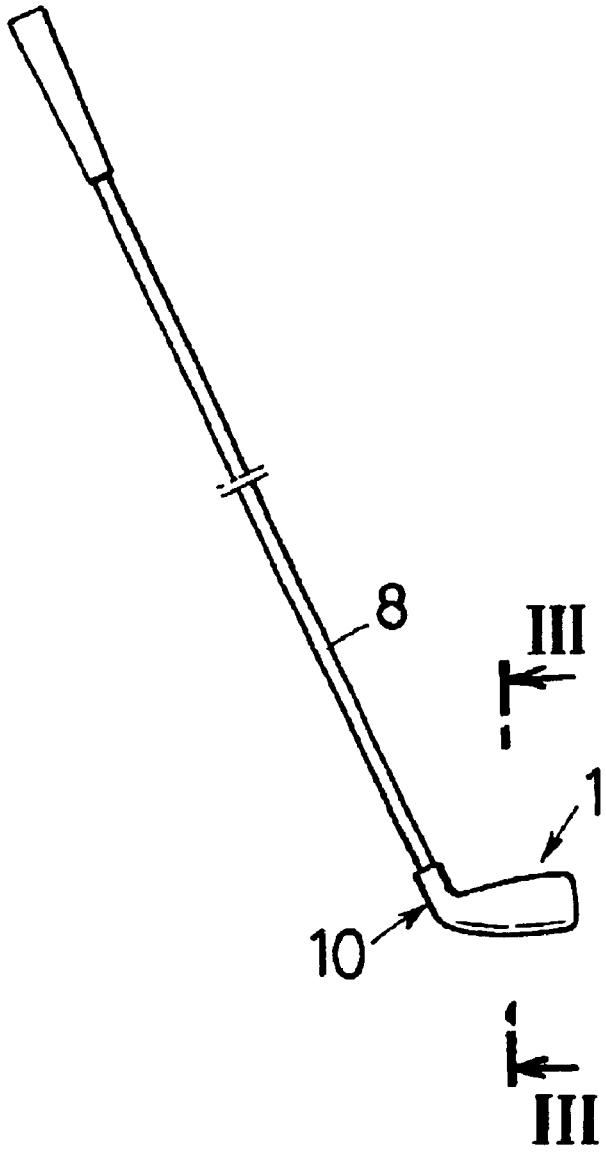
FIG. 1 is an external view showing the appearance of an iron golf club.
Figure 2:
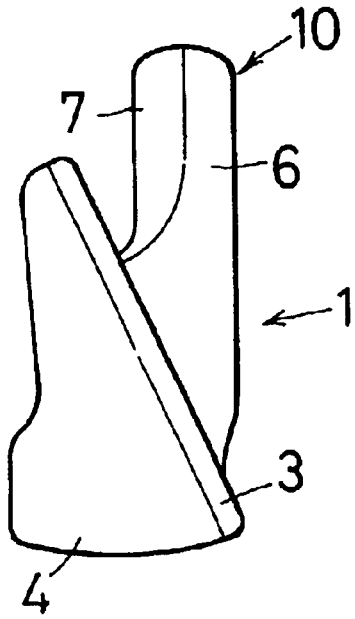
FIG. 2 is a front view of a hollow iron clubhead showing an embodiment of the present invention.
Figure 3:
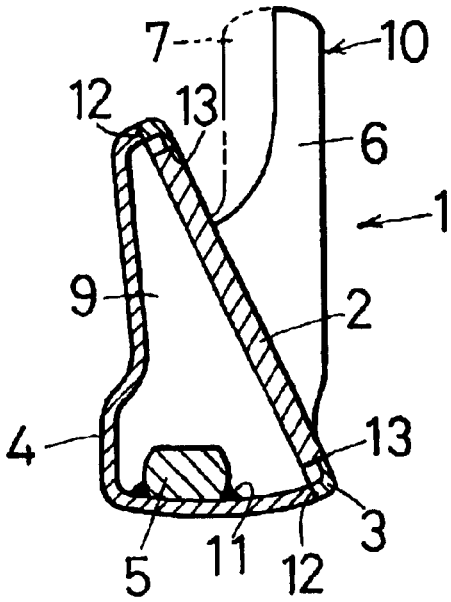
FIG. 3 is a sectional view taken along the line III—III in FIG. 1.

An embodiment of the present invention will be described below in detail with reference to the accompanying drawings. FIG. 1 is an external view showing the appearance of an iron golf club. FIG. 2 is a front view of a hollow iron clubhead showing an embodiment of the present invention. FIG. 3 is a sectional view taken along the line III—III in FIG. 1. A hollow iron clubhead 1 according to an embodiment of the present invention comprises approximately three members: a clubface member 2; a front body member 3 integrally welded to the clubface member 2 to constitute a front body portion of the hollow iron clubhead 1; and a rear body member 4 integrally welded to the front body member 3 to constitute a rear body portion of the hollow iron clubhead 1.

The front body member 3 is integrally formed with a half hosel portion 6 having a shape formed by cutting a cylinder along a plane containing a center axis of the cylinder. Similarly, the rear body member 4 is integrally formed with a half hosel portion 7 having a shape formed by cutting a cylinder along a plane containing a center axis of the cylinder. As will be described later, the half hosel portion 6 and the half hosel portion 7 are integrally welded together to form a hosel 10 for securing one end of a golf clubshaft 8.

The hosel 10 is a tubular hosel communicating with a hollow 9 that is a space defined by the clubface member 2, the front body member 3 and the rear body member 4. The tubular hosel 10 allows a reduction in weight of the iron clubhead and permits a design that facilitates lowering the center of gravity, as will be described later. The front body member 3 has a through-hole 22 formed therein as will be described later. The clubface member 2 is inserted in the through-hole 22 and secured to the front body member 3.

The clubface member 2 and the front body member 3 are integrally secured to each other by a weld 13 along the outer periphery of the clubface member 2 and the joint portion of the through-hole 22. The front body member 3 and the rear body member 4 are integrally secured to each other by a weld 12 along the joint surface therebetween. Accordingly, the clubface member 2, the front body member 3 and the rear body member 4 are integrated together by the weld 13 and the weld 12.

The hollow iron clubhead 1 has a hollow 9 defined therein. A weight member 5 is secured to the bottom of the hollow 9 by welding as shown by reference numeral 11. In this embodiment, the weight member 5 is formed by forging a bar stock. Because the hosel 10 is a hollow structure, a weight member 5 equal in weight to the solid portion that the hosel 10 would have if it were solid can be placed at any desired position in the hollow 9 on the assumption that the hollow iron clubhead 1 has the same configuration and the same weight as those of the conventional iron clubhead. Therefore, the design freedom for positioning of the gravity center increases.

[Method of Producing Iron Clubhead]

Figure 4:
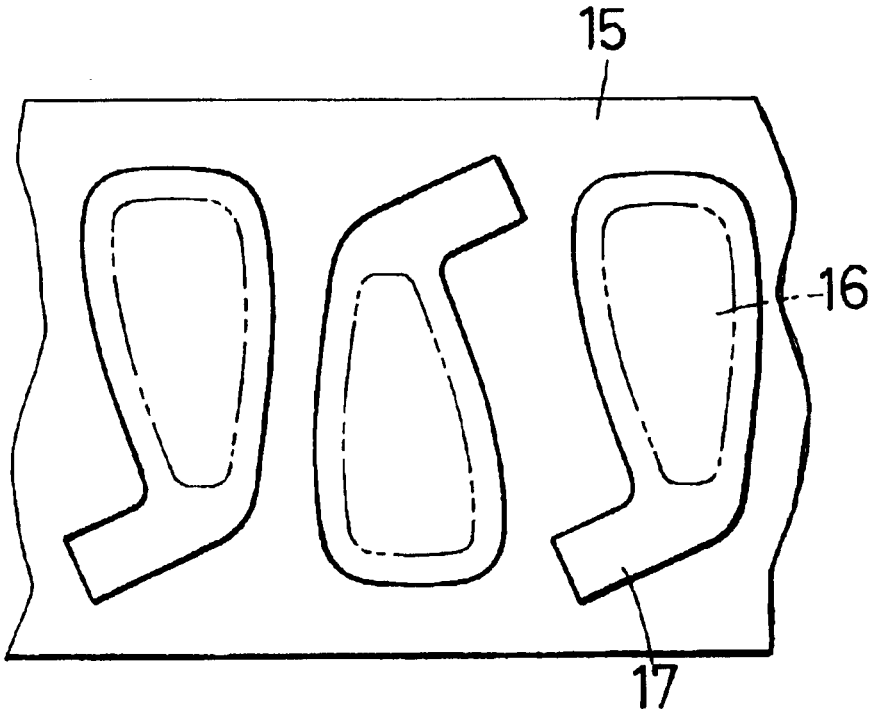
FIG. 4 is a plan view showing the way in which a front body blank is cut out of a sheet material by blanking.
Figure 5:
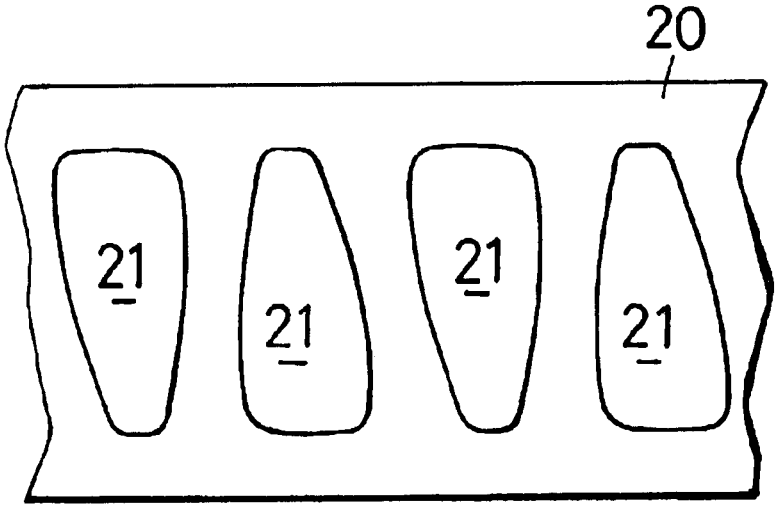
FIG. 5 is a plan view showing the way in which a clubface blank is cut out of a sheet material by blanking.

The front body member 3 and the clubface member 2 are produced as follows. FIG. 4 is a plan view showing the way in which a front body blank is cut out of a sheet material by blanking. To produce the front body member 3, first, as shown in FIG. 4, a clubface-corresponding portion 16 corresponding to the clubface member 2 is blanked as scrap from a sheet material 15, which is a steel material. Thereafter, a front body blank 17 is cut out by blanking, which is the front body member 3 before being subjected to press working. FIG. 5 is a plan view showing the way in which a clubface blank is cut out of a sheet material by blanking.

To produce the clubface member 2, as shown in FIG. 5, a clubface blank 21 is prepared by blanking a sheet material 20 which is a steel material different in kind from the sheet material 15 of the front body member 3. The sheet material 20 is also different in thickness from the sheet material 15. As a material of the clubface blank 21, for example, a thin and highly resilient spring steel material may be used. It should be noted that the front body blank 17 and the clubface blank 21 may be cut out by a cutting method other than blanking, e.g. gas cutting or sawing.

Figure 6:
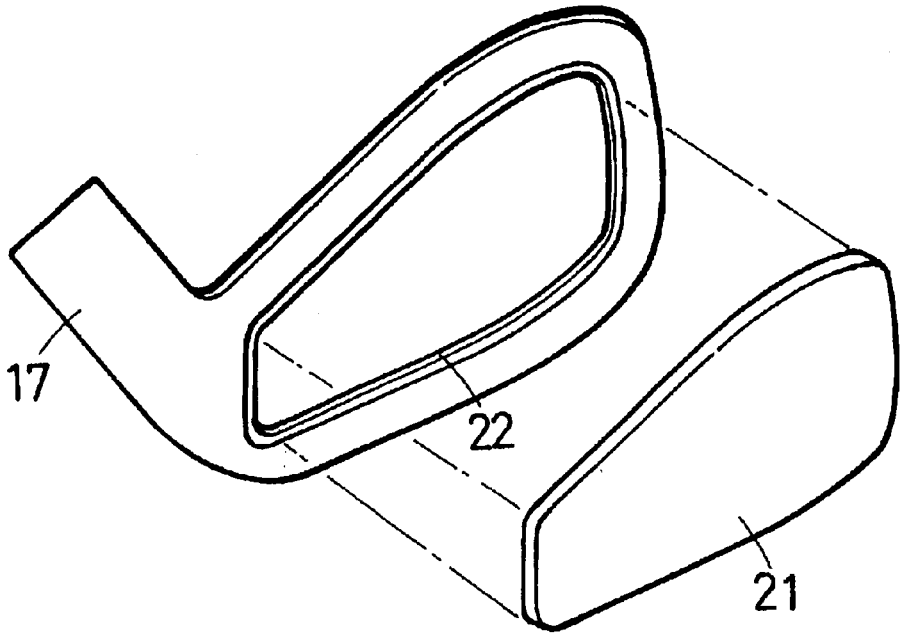
FIG. 6 is a three-dimensional view showing the relationship between the front body blank and the clubface blank.

FIG. 6 is a three-dimensional view showing the relationship between the front body blank 17 and the clubface blank 21. The front body blank 17 has a through-hole 22. The through-hole 22 is provided for insertion of the clubface blank 21. The front body blank 17 and the clubface blank 21 are secured together by the weld 13. Preferable welding methods for forming the weld 13 are laser welding, TIG arc welding using a non-consumable tungsten rod as an electrode, and a welding method of joining the base metal without using a welding rod, such as electron beam welding. These welding methods have the advantage that there will be no excess padding or slag after welding and hence the post-treatment can be performed easily.

Figure 7:
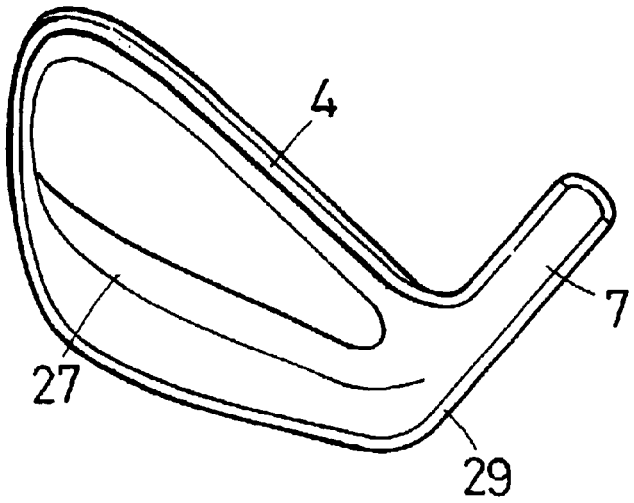
FIG. 7 is an external view showing the appearance of the front body member and the clubface member formed by drawing.

After the front body blank 17 and the clubface blank 21 have been joined together by laser welding, the blank assembly is inserted into a press die for drawing and pressurized under heating to not less than the recrystallization temperature of the material of the clubface blank 21, whereby the front body member 3 is formed into a desired configuration by drawing, that is, by hot drawing. FIG. 7 is an external view showing the appearance of the front body member and the clubface member formed as described above. By the drawing process, a raised portion 25, a half hosel portion 6 and a groove 26 are formed.

The groove 26 is formed around the outer periphery of the clubface member 2. The portion of the front body member 3 where the groove 26 is formed is where the clubface member 2 is secured to the front body member 3, and it is somewhat thinner in wall thickness than the other portion of the front body member 3. Therefore, the groove 26 thus formed allows expectation of desired spring characteristics and the like. The raised portion 25 is a joint where the front body member 3 is welded to the rear body member 4. After being removed from the press die, the front body member 3 integrally welded with the clubface member 2 is subjected to shot blasting (not shown) to clean the surface thereof.

After the cleaning process, scorelines and face shape lines are formed in the striking face of the clubface member 2 by coining. The face shape lines are guide lines for cutting the iron clubhead 1 with a file, a polishing belt, etc. to adjust the appearance thereof after the clubhead body members have been assembled by welding. Upon completion of the coining process, the joint surface 28 is cut into a desired three-dimensional surface by, for example, an end mill of a machining center that moves along the designed configuration.

Figure 8:
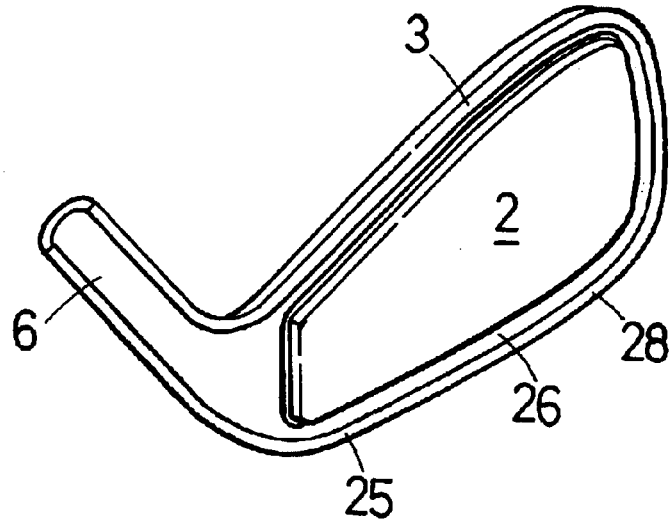
FIG. 8 is a three-dimensional view showing a rear body member.

FIG. 8 is a three-dimensional view showing the rear body member 4. The rear body member 4 is produced in the same way as in the case of the front body member 3. That is, a blank for forming the rear body member 4 is cut out of a sheet material, which is a steel material, by blanking, and then subjected to drawing under heating to not less than the recrystallization temperature of the material. By the hot drawing process, a recessed or raised area 27 necessary for the iron clubhead is formed. Thereafter, a weight member 5 is secured to the bottom of the rear body member 4 by welding as shown by reference numeral 11 in FIG. 3.

Welding the weight member 5 allows the center of gravity of the hollow iron clubhead 1 to be lowered. Further, the joint surface 29 of the rear body member 4 is cut into a desired three-dimensional surface by, for example, an end mill of a machining center that moves along the designed configuration. The joint surface 28 of the front body member 3 and the joint surface 29 of the rear body member 4 are the same three-dimensional surface. Thus, the front body member 3 and the rear body member 4 are joined to each other with a jig and welded together in this state.

Thereafter, various processes may be carried out according to need, for example, correction of the angle between the hosel 10 and the clubface member 2, tapping and reaming performed on the inner peripheral surface of the hosel 10, chamfering of each corner, and finishing processing by plating, buffing, etc. Thus, the desired clubhead is completed.

[Other Embodiments]

Figure 9:
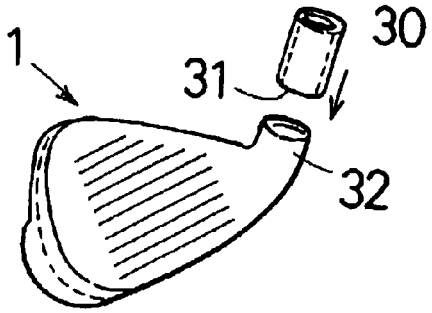
FIGS. 9(*a*) and 9(*b*) are diagrams showing another method of producing a hosel.
Figure 9:
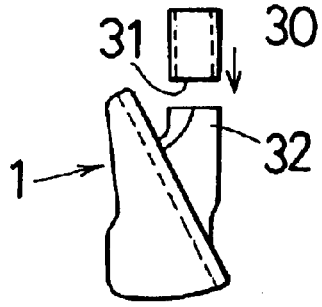

FIGS. 9(*a*) and 9(*b*) show another embodiment in which the hosel is secured to the clubhead by welding. The hosel 30 is prepared by cutting a bar stock on a lathe or by cutting a general-purpose pipe material. An end surface 31 of the hosel 30 is secured to a hosel base 32 of the hollow iron clubhead 1 by welding. This production method has the advantage that the configuration and material of the hosel 30 can be selected freely, and hence the design freedom increases.

EXAMPLES

An example of the material, plate thickness and processing conditions of each constituent part of the above-described iron clubhead will be shown below.

Front body member 3:

material: S20C; plate thickness: 2.5 mm

Clubface member 2 material: SUP-10; plate thickness: 2.5 mm

Rear body member 4 material: S20C; plate thickness: 2.5 mm

Weight member 5 material: SS400; diameter: 12 mm

Hot forming of the front body member 3 and the clubface member 2 was carried out at a temperature of 800 to 900° C. Similarly, the hot forming of the rear body member 4 was carried out at a temperature of 800 to 900° C. Welding of the front body member 3 and the clubface member 2 was performed by laser welding. Welding of the front body member 3 and the rear body member 4 was also performed by laser welding. Welding of the weight member 5 to the rear body member 4 was performed by TIG arc welding.

[Experimental Examples]

FIG. 10 is a diagram showing data for comparison of an iron golf club (#6) produced by the above-described example of the present invention and an iron golf club (#6) as a comparative example. That is, the diagram shows data obtained by trial shots played with the iron golf clubs by a golf-ball hitting robot and data concerning the gravity center positions thereof. In the comparative example, a portion of the iron golf club corresponding to the front body member 3 in the example of the present invention was produced by forging, and a portion corresponding to the hosel 30 was a solid structure.

The data shown in FIG. 10 reveals that the iron golf club having the structure according to the example of the present invention is lower in the back spin rate (rotational speed of the ball) at launch and also longer in carry (i.e. ball flying distance) than the comparative example, although it suffers some lateral deflection in comparison to the comparative example. The data also indicates that the iron golf club according to the example of the present invention has a center of gravity located low and rearward of the clubface (i.e. deep center of gravity) in comparison to the comparative example. This is assumed to be the reason for the reduction in the back spin rate at launch.

As has been detailed above, the golf club and the golf club producing method according to the present invention offer the following advantages.

According to the present invention, the hosel is formed in a tubular shape. Therefore, it becomes possible to create a low center of gravity and to set the center of gravity at any desired position in the longitudinal direction of the clubhead. Further, because a material for the clubface member can be selected as desired, the coefficient of restitution, etc. can be adjusted easily. Hence, the design freedom is increased. In addition, the manufacture of the golf club is easy because the clubhead is formed by press working from a sheet metal material.

It should be noted that the present invention is not necessarily limited to the foregoing embodiments but can be modified in a variety of ways without departing from the gist of the present invention.

What is claimed is:

1. A golf club having a hollow iron clubhead with a hollow therein, said golf club comprising:

a clubface member having a striking face for striking a golf ball;

a front body member integrally welded to said clubface member to constitute a front body portion of said hollow iron clubhead, said front body member having a first hosel portion for forming a tubular hosel communicating with said hollow said clubface member is positioned in a through-hole formed in said front body member and welded to said front body member, said clubface member is different in constituent material from said front body member; and a rear body member integrally welded to said front body member to constitute a rear body portion of said hollow iron clubhead, said rear body member having a second hosel portion for forming said tubular hosel in combination with said first hosel portion.

2. A golf club according to claim 1, wherein said first hosel portion and said second hosel portion are half hosel portions, respectively, each having a shape formed by cutting a cylinder along a plane containing a center axis thereof, said half hosel portions being welded together to form said hosel for securing one end of a golf clubshaft.

3. A golf club according to claim 1 or 2, wherein a weight member is secured to a bottom of said rear body member by welding.

4. A golf club according to claim 1, wherein a cylindrical member for securing one end of a golf clubshaft is joined to said hosel by welding.

* * * * *